US011350209B2

(12) United States Patent
Zhao et al.

(10) Patent No.: US 11,350,209 B2
(45) Date of Patent: May 31, 2022

(54) NOISE REDUCTION HEADSET HAVING MULTI-MICROPHONE AND NOISE REDUCTION METHOD

(71) Applicant: GOERTEK INC., Shandong (CN)

(72) Inventors: Yanpeng Zhao, Shandong (CN); Minlong Xu, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 17/259,738

(22) PCT Filed: Jul. 3, 2019

(86) PCT No.: PCT/CN2019/094569
§ 371 (c)(1),
(2) Date: Jan. 12, 2021

(87) PCT Pub. No.: WO2020/019956
PCT Pub. Date: Jan. 30, 2020

(65) Prior Publication Data

US 2021/0144469 A1 May 13, 2021

(30) Foreign Application Priority Data

Jul. 24, 2018 (CN) ..... 201810815645.9

(51) Int. Cl.
*H04R 1/32* (2006.01)
*H04R 1/10* (2006.01)

(52) U.S. Cl.
CPC ..... *H04R 1/326* (2013.01); *H04R 1/1066* (2013.01); *H04R 1/1075* (2013.01); *H04R 2201/105* (2013.01); *H04R 2430/21* (2013.01)

(58) Field of Classification Search
None
See application file for complete search history.

(56) References Cited

U.S. PATENT DOCUMENTS

2010/0081487 A1* 4/2010 Chen ..... H04R 3/00 455/575.1
2017/0238109 A1* 8/2017 Gong ..... G01S 15/08 381/58

* cited by examiner

*Primary Examiner* — Kenny H Truong
(74) *Attorney, Agent, or Firm* — Paratus Law Group, PLLC

(57) ABSTRACT

There is provided a noise reduction headset having multi-microphone and a noise reduction method. One embodiment of the headset includes a headband and headset bodies respectively connected to both ends of the headband, wherein the headset further includes a microprocessor and at least three microphones disposed on an outer surface of the headset body; the microprocessor is configured to select the microphone closest to a target sound source as a main microphone according to a comparison of sound signals picked up by respective microphones, select the microphone farthest from the main microphone as an auxiliary microphone according to a preset relative position of respective microphones, and execute a noise reduction algorithm by using a first sound signal picked up by the main microphone and a second sound signal picked up by the auxiliary microphone as inputs of the noise reduction algorithm so as to realize noise reduction. According to the embodiment, the noise reduction performance can be ensured under the condition that the user does not wear the headset normally.

12 Claims, 3 Drawing Sheets

NOISE REDUCTION HEADSET HAVING MULTI-MICROPHONE AND NOISE REDUCTION METHOD

The application is a National Stage Patent Application under 35 U.S.C. § 371 of PCT International Patent Application No. PCT/CN2019/094569 which was filed on Jul. 3, 2019, which claims the priority of a Chinese application 201810815645.9 which was filed with the Chinese patent office on Jul. 24, 2018 and titled as "A noise reduction headset having multi-microphone and a noise reduction method", and the entire contents thereof are all incorporated herein by reference.

TECHNICAL FIELD OF THE INVENTION

The application relates to the field of noise reduction of headsets. More specifically, the application relates to a noise reduction headset having multi-microphone and a noise reduction method.

BACKGROUND OF THE INVENTION

The conventional headphone, especially the headset, generally has an uplink noise reduction function. The uplink noise reduction function mainly eliminates the local environmental noise as much as possible when a user makes a call by using the headset, and ensures that the voice signal is transmitted to the opposite end as clearly as possible to ensure the call quality.

Currently, the uplink noise reduction of the headset is mainly realized by a single microphone or a dual microphone cooperating with a noise reduction algorithm. Wherein, the general principle of combining the dual microphone with the noise reduction algorithm is as follows: In a dual microphone, the main microphone is located close to the target sound source, i.e., the user's mouth, and the auxiliary microphone is located farther away from the user's mouth. Since a certain distance exists between the main microphone and the auxiliary microphone, but the certain distance is not too far, and since the distance between the user's mouth and the main microphone and the auxiliary microphone is far less than the distance between the noise source in the surrounding environment and the main microphone and the auxiliary microphone, the noise signals in the surrounding environment in the sound signals picked up by the main microphone and the auxiliary microphone are not different. When the user wears the headset in a normal wearing manner as shown in FIG. 1, there are an amplitude difference, a time difference, and a phase difference in voice signals in the sound signals picked up by the main microphone and the auxiliary microphone. The sound signals picked up by the main microphone and the auxiliary microphone are an input of the noise reduction algorithm, and the noise reduction algorithm is executed to analyze the waveform of the sound signals picked up by the main microphone and the auxiliary microphone. An amplitude difference, a time difference or a phase difference (usually a time difference or a phase difference) of the voice signals in the sound signals picked up by the primary and auxiliary microphones is used to remove the noise signal from the voice signal.

The noise reduction performance of the dual microphone combined with the noise reduction algorithm depends largely on the position of the main and auxiliary microphones. In particular, on the one hand, the distance between the main microphone and the auxiliary microphone is relatively far, usually not less than 20 mm. On the other hand, the angle between the line between the main microphone and the auxiliary microphone and the line between the main microphone and the mouth of the user should be sufficiently small, and ideally the angle is zero, that is, the line between the auxiliary microphone, the main microphone and the target sound source forms a straight line. In summary, the distance between the main microphone and the auxiliary microphone is large, and the included angle is small, so that the noise reduction performance is good.

With respect to the connection line between the main microphone and the auxiliary microphone and the connection line between the main microphone and the mouth of the user, the headset is designed so that the connection lines of the auxiliary microphone, the main microphone and the target sound source form a straight line when the user wears the headset in a normal wearing manner as shown in FIG. 1. However, due to fatigue and uncomfortable feeling caused by wearing the headset too long, the user often wears the headset in an abnormal wearing manner as shown in FIG. 2. At this time, the included angle between the line between the main microphone and the auxiliary microphone and the line between the main microphone and the mouth of the user increases, and the noise reduction performance decreases. Furthermore, in order to solve the problems regarding wearing comfort and head characteristics of different people, a rotating mechanism such as a rotating shaft is usually provided at a position where the headset body and the headband are engaged, so that the headset body can rotate and tilt within a certain angle, resulting in that the headset body can be attached to the head of the user as much as possible when being worn. The included angle between the line between the main microphone and the auxiliary microphone and the line between the main microphone and the mouth of the user can be increased, and the noise reduction performance can be reduced. In this case, the rotation of the headset body can also be considered as an abnormal wearing method. However, in such condition, the included angle between the line between the main microphone and the auxiliary microphone and the line between the main microphone and the mouth of the user may only increase to a limited extent, and the effect on the noise reduction performance is relatively small compared with the abnormal wearing method shown in FIG. 2.

Accordingly, there is a need to provide a noise reduction headset having multi-microphone and a noise reduction method for ensuring noise reduction performance, particularly in the case where a user does not normally wear the headset.

SUMMARY OF THE INVENTION

It is an object of the present application to provide a noise reduction headset having multi-microphone and a multi-microphone noise reduction method for ensuring noise reduction performance, in particular, when a user is not normally wearing a headset.

To achieve the above object, the present application adopts the following technical solution:

A first aspect of the present application provides a noise reduction headset having multi-microphone comprising a headband and headset bodies respectively connected to both ends of the headband, wherein the headset further comprises a microprocessor and at least three microphones disposed on an outer surface of the headset body;

The microprocessor is configured to select the microphone closest to a target sound source as a main microphone according to a comparison of sound signals picked up by respective microphones, select the microphone farthest from the main microphone as an auxiliary microphone according to a preset relative position of respective microphones, and execute a noise reduction algorithm by using a first sound signal picked up by the main microphone and a second sound signal picked up by the auxiliary microphone as inputs of the noise reduction algorithm so as to realize noise reduction.

In some embodiments, the at least three microphones are respectively arranged on an edge of the outer surface of the headset body.

In some embodiments, the noise reduction headset having multi-microphone comprises at least four microphones, wherein the at least four microphones are circumferentially and uniformly distributed on the edge of the outer surface of the headset body.

In some embodiments, the microprocessor is configured to fuse and compare the sound signals picked up by the microphones other than the main and auxiliary microphones with the second sound signal picked up by the auxiliary microphone according to the preset relative positions of the microphones, so as to obtain the virtually picked-up fused sound signal from the position of the edge of the outer surface of the headset body remote from the main microphone in the extension line of the line between the main microphone and the target sound source, and use the first sound signal and the fused sound signal as inputs of the noise reduction algorithm.

In some embodiments, at least one other microphone is arranged in the vicinity of the auxiliary microphone.

A second aspect of the present application provides a multi-microphone noise reduction method comprising:

arranging at least three microphones on the outer surface of the headset body;

selecting the microphone closest to a target sound source as a main microphone according to a comparison of sound signals picked up by respective microphones, selecting the microphone farthest from the main microphone as an auxiliary microphone according to a preset relative position of respective microphones, and executing a noise reduction algorithm by using a first sound signal picked up by the main microphone and a second sound signal picked up by the auxiliary microphone as inputs of the noise reduction algorithm so as to realize noise reduction.

In some embodiments, the arranging at least three microphones on the outer surface of the headset body further comprises arranging at least three microphones on the edge of the outer surface of the headset body.

In some embodiments, the arranging at least three microphones on the edge of the outer surface of the headset body further comprises circumferentially and uniformly distributing at least four microphones on the edge of the outer surface of the headset body.

In some embodiments, the method further comprises:

fusing and comparing the sound signals picked up by the microphones other than the main and auxiliary microphones with the second sound signal picked up by the auxiliary microphone according to the preset relative position of the microphones, so as to obtain the virtually picked-up fused sound signal from the position of the edge of the outer surface of the headset body remote from the main microphone in the extension line of the line between the main microphone and the target sound source, and use the first sound signal and the fused sound signal as inputs of the noise reduction algorithm.

Advantageous effects of the present application are as follows:

According to the technical solution of the present application, the noise reduction performance can be ensured, and in particular, the noise reduction performance can be ensured when the user wears the headset abnormally.

BRIEF DESCRIPTION OF THE DRAWINGS

A more detailed description of an embodiment of the present application is given below in conjunction with the accompanying drawings.

DETAILED DESCRIPTION OF THE INVENTION

The technical solution of the embodiments of the present application will be described with reference to the accompanying drawings. Apparently, the embodiments described below are merely a portion of but not all-inclusive embodiments. Based on the embodiments of the application, other embodiments obtained by those skilled in the art without any inventive efforts are also included in the protection scope of the application.

Figure 1:
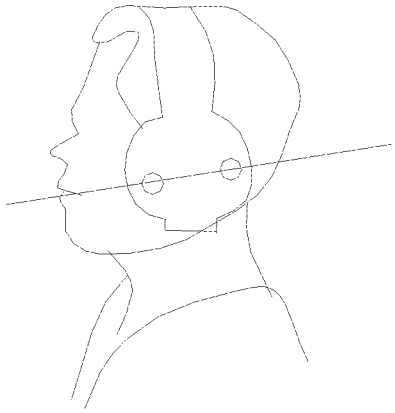
FIG. 1 shows a schematic diagram of a user wearing a headset in a normal wearing manner.
Figure 2:
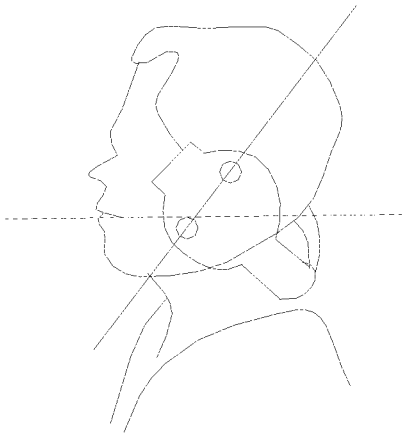
FIG. 2 shows a schematic diagram of a user wearing a headset in an abnormal wearing manner.
Figure 3:
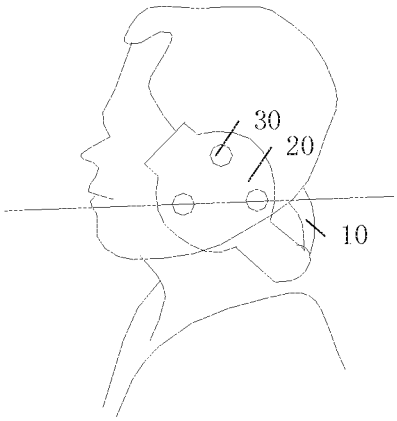
FIG. 3 shows a schematic diagram of a user wearing a noise reduction headset having multi-microphone in an abnormal wearing manner according to an embodiment of the present application.

As shown in FIG. 3, an embodiment of the present application provides a noise reduction headset having multi-microphone comprising a headband 10 and headset bodies 20 respectively connected at both ends of the headband 10, and further comprising a microprocessor and at least three microphones 30 disposed on an outer surface of the headset body, wherein the outer surface of the headset body is a surface remote from a user;

The microprocessor is configured to select the microphone 30 closest to the target sound source as the main microphone by comparing sound signals respectively picked up by the at least three microphones, select the microphone 30 farthest from the main microphone as the auxiliary microphone according to the preset relative positions of the microphones 30, use the first sound signal picked up by the main microphone and the second sound signal picked up by the auxiliary microphone as inputs of a noise reduction algorithm, and execute the noise reduction algorithm to reduce noise.

Wherein the sound signals picked up by the microphones 30 include a target sound signal emitted by the target sound source and a noise signal generated by the noise source in the surrounding environment, and the comparison of the sound signals picked up by the microphones 30 can be made in accordance with one or more of an amplitude difference, a time difference, and a phase difference of the waveforms of the sound signals. The noise reduction algorithm may employ various algorithms such as a delay-accumulation method (conventional beam method), an adaptive beam method, and a microphone array method based on post-adaptive filtering, which are not limited in the present embodiment.

As shown in FIG. 3, the present embodiment provides a noise reduction headset having three microphones. A microprocessor, not shown, may be provided in the headset body 20 or in the headband 10. The present embodiment is not limited to a headset in which only one headset body 20 is connected to one end of the headband 10. A person skilled in the art can select the headset according to actual requirements. It will be appreciated by those skilled in the art that if the headset bodies 20 are connected to both ends of the headband 10 respectively, the two headset bodies 20 may be simultaneously noise-reduced or only one headset body 20 needs to be noise-reduced as required, and three microphones 30 may be arranged on the outer surfaces of the two headset bodies 20 respectively, or three microphones 30 may be arranged on the outer surfaces of only one of the two headset bodies 20.

According to the noise reduction headset having multi-microphone provided in the present embodiment, at least three microphones 30 are arranged, and the microphone 30 closest to the target sound source is selected as the main microphone, and the microphone 30 farthest from the main microphone is selected as the auxiliary microphone according to the preset relative position of each microphone 30. In comparison with the conventional dual microphone, in the case of abnormal wearing by the user, it is possible to make the included angle between the connection line between the main microphone and the auxiliary microphone and the connection line between the main microphone and the target sound source (for example, the mouth of the user) be reduced, or to arrange the auxiliary microphone approximately on the extended line of the connection line between the main microphone for picking up the target sound signal emitted by the target sound source and the target sound source (most desirably, on the connection line between the auxiliary microphone, the main microphone and the target sound source forms a straight line), so that the two sound signals picked up by the main microphone and the auxiliary microphone according to which the microprocessor performs the noise reduction algorithm are more compatible with the theoretical angle of the noise reduction algorithm, and the noise reduction performance is better. The noise reduction headset having multi-microphone provided by the present embodiment is suitable for various environments, in particular, environments where noises are high, such as bars, farmers' markets, machinery processing plants, and the like.

In some alternative implementations of the present embodiment, at least three microphones 30 are arranged at the edge of the outer surfaces of the headset body 20, respectively. With this implementation, it can be ensured that the distance between the main microphone and the auxiliary microphone is as far as possible, and two sound signals picked up by the main microphone and the auxiliary microphone according to which the microprocessor performs the noise reduction algorithm are more compatible with the theoretical angle of the noise reduction algorithm, and the noise reduction performance is better.

Figure 4:
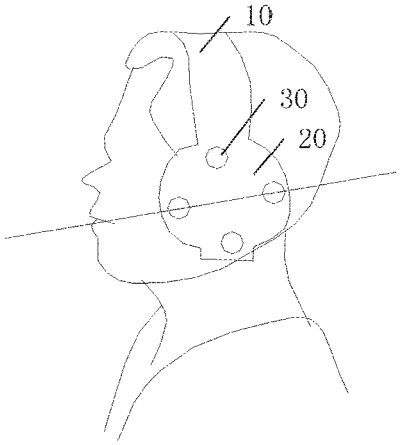
FIG. 4 shows a schematic diagram of a user wearing a noise reduction headset having multi-microphone in a normal wearing manner according to an alternative implementation of the present embodiment.
Figure 5:
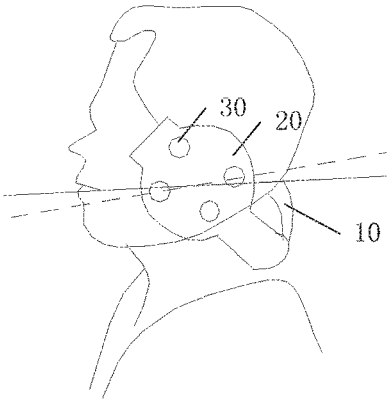
FIG. 5 shows a schematic diagram of a user wearing a noise reduction headset having multi-microphone in an abnormal wearing manner according to an alternative implementation of the embodiment.

In some alternative implementations of the present embodiment, as shown collectively in FIGS. 4 and 5, the noise reduction headset having multi-microphone includes at least four microphones 30 circumferentially and uniformly distributed over the edge of the outer surfaces of the headset body 20. The specific number of microphones 30 in this implementation is four. In this embodiment, when the user wears the headset in an abnormal manner, the circumferentially uniform distribution makes the included angle between the connection line between the main microphone and the auxiliary microphone and the connection line between the main microphone and the target sound source be reduced. In addition, since the outer surface of the headset body is generally substantially square or substantially circular, if three microphones 30 are arranged, the circumferentially uniform distribution of the three microphones 30 on the edges cannot realize that the included angle between the connection line between the main microphone and the auxiliary microphone and the connection line between the main microphone and the target sound source is zero when the user wears the headset in an abnormal manner. Therefore, in this embodiment, at least four microphones 30 are arranged. It will be appreciated that respective microphones 30 may also be linearly or L-shaped arranged on the edge of the outer surface of the headset body 20.

In some alternative implementations of the present embodiment, the microprocessor fuses and compares the sound signals picked up by the microphones other than the main and auxiliary microphones with the second sound signal picked up by the auxiliary microphone according to the preset relative positions of the microphones 30, so as to obtain the virtually picked-up fused sound signal from the position of the edge of the outer surface of the headset body 20 remote from the main microphone in the extension line of the line between the main microphone and the target sound source, and use the first sound signal and the fused sound signal as inputs of the noise reduction algorithm. According to this implementation, the angle between the line between the main microphone and the auxiliary microphone and the line between the main microphone and the target sound source cannot be approximately zero when the user wears the headset abnormally, thus, the sound signals picked up by the other microphones and the second sound signal picked up by the auxiliary microphone are fused and compared according to the fixed preset relative positions of the microphones 30, so as to obtain the virtually picked-up fused sound signal from the position of the edge of the outer surface of the headset body 20 remote from the main microphone in the extension line of the line between the main microphone and the target sound source, and the noise reduction algorithm is executed by using the first sound signal and the fused sound signal as inputs of the noise reduction algorithm, thereby improving the noise reduction performance. Specifically, an amplitude difference, a time difference or a phase difference of a target sound signal emitted from a target sound source in a sound signal picked up by respective microphone 30 may be compared and fused, the fused amplitude difference, the fused time difference or the fused phase difference (usually using the time difference or the phase difference) in combination with a preset relative position of respective microphone 30 (a constant relative distance between the adjacent microphones 30 and a constant included angle between the lines between one microphone and adjacent microphones caused by a constant preset relative position) is analyzed to obtain information such as an estimated sound signal waveform of respective position on the outer surface of the headset body 20 in an extension line of a connection line between the main microphone and the target sound source, so as to estimate a virtually picked-up fused sound signal from the position of the edge of the outer surface of the headset body 20 remote from the main microphone in the extension line of the line between the main microphone and the target sound source, also namely, an estimated sound signal of the position. The fused sound signal and the first sound signal are used as inputs to perform a noise reduction algorithm, and noise reduction performance is improved. It should be noted that this implementation is more suitable for improving the noise reduction performance in the condition that the angle between the line between the main microphone and the auxiliary microphone and the line between the main microphone and the user's mouth is increased by a limited amplitude when rotating the headset body 20.

Figure 6:
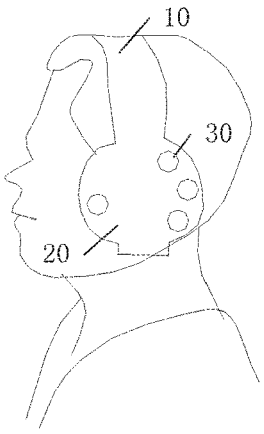
FIG. 6 shows a schematic diagram of a user wearing a noise reduction headset having multi-microphone in a normal wearing manner according to another alternative implementation of this embodiment.

In some alternative implementations of the present embodiment, as shown in FIG. 6, at least one other microphone is arranged in the vicinity of the auxiliary microphone. With this implementation, the estimated virtually picked-up fused sound signal is more accurate.

Another embodiment of the present application provides a multi-microphone noise reduction method comprising:

arranging at least three microphones on the outer surface of the headset body;

selecting the microphone closest to a target sound source as a main microphone according to a comparison of sound signals picked up by respective microphones, selecting the microphone farthest from the main microphone as an auxiliary microphone according to a preset relative position of respective microphones, and executing a noise reduction algorithm by using a first sound signal picked up by the main microphone and a second sound signal picked up by the auxiliary microphone as inputs of the noise reduction algorithm so as to realize noise reduction.

In some alternative implementations of the present embodiment, arranging at least three microphones on the outer surface of the headset body further comprises arranging at least three microphones on the edge of the outer surface of the headset body.

In some alternative implementations of the present embodiment, arranging at least three microphones at the edge of the outer surface of the headset body further comprises uniformly distributing at least four microphones at the edge of the outer surface of the headset body circumferentially.

In some alternative implementations of this embodiment, the multi-microphone noise reduction method provided in this embodiment further comprises:

Fusing and comparing the sound signals picked up by the microphones other than the main and auxiliary microphones with the second sound signal picked up by the auxiliary microphone according to the preset relative positions of the respective microphones, so as to obtain the virtually picked-up fused sound signal from the position of the edge of the outer surface of the headset body 20 remote from the main microphone in the extension line of the line between the main microphone and the target sound source, and using the first sound signal and the fused sound signal as inputs of the noise reduction algorithm.

It should be noted that the multi-microphone noise reduction method provided in the present embodiment is similar to the principle and working flow of the noise reduction headset having multi-microphone provided in the foregoing embodiment. Reference may be made to the above description, and details are not described herein.

Figure 7:
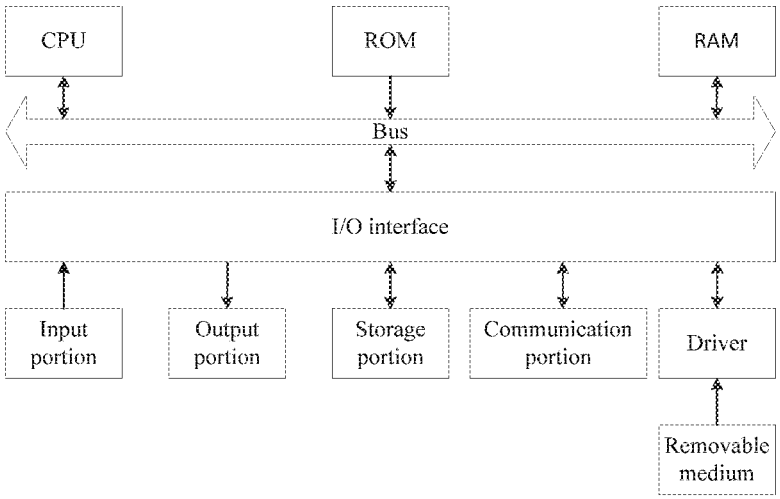
FIG. 7 shows a schematic structural diagram of a microprocessor according to an embodiment of the present application.

As shown in FIG. 7, a computer system suitable for implementing the microprocessor provided in the present embodiment includes a central processing unit (CPU) that may perform various appropriate actions and processes according to a program stored in a read-only memory (ROM) or a program loaded from a storage portion into a random access memory (RAM). In the RAM, various programs and data required for the operation of the computer system are also stored. The CPU, the ROM, and the RAM are connected via a bus. An input/output (I/O) interface is also connected to the bus.

The following components are connected to the I/O interface: an input portion including a keyboard, a mouse, and the like; an output portion including a liquid crystal display (LCD) or the like and a speaker or the like; a storage portion including a hard disk or the like; and a communication portion including a network interface card such as a LAN card, a modem, or the like. The communication portion performs communication processing via a network such as the Internet. The driver is also connected to the I/O interface as desired. A removable medium, such as a magnetic disk, an optical disk, a magneto-optical disk, a semiconductor memory, or the like, is mounted on the driver as required so that a computer program read therefrom is mounted into the storage portion as required.

In particular, according to the present embodiment, the process described in the flowchart above may be implemented as a computer software program. For example, the present embodiment includes a computer program product comprising a computer program tangibly embodied on a computer readable medium, wherein the computer program comprises program code for performing the method shown in the flowchart. In such embodiments, the computer program may be downloaded and installed from the network through the communication portion, and/or installed from a removable medium.

Flowcharts and schematic diagrams in the drawings illustrate architectures, functions, and operations of possible implementations of the systems, methods, and computer program products of the embodiments. In this regard, each block in a flowchart or diagram may represent a module, program segment, or portion of code that contains one or more executable instructions for implementing the specified logical functions. It should also be noted that in some alternative implementations, the functions noted in the blocks may also occur in an order different from that noted in the drawings. For example, two successively represented blocks may actually be executed substantially in parallel, and they may sometimes be executed in the reverse order, depending on the functionality involved. It is also noted that each block in the schematic and/or flowchart illustrations, and combinations of blocks in the schematic and/or flowchart illustrations, may be implemented with a dedicated hardware-based system that performs the specified functions or operations, or may be implemented with a combination of dedicated hardware and computer instructions.

As another aspect, the present embodiment further provides a non-volatile computer storage medium, which may be a non-volatile computer storage medium included in the above-described apparatus in the above-described embodiment, or a non-volatile computer storage medium which exists separately and is not installed in a terminal. The non-volatile computer storage medium stores one or more programs that, when executed by a device, cause the device to:

select the microphone closest to a target sound source as a main microphone according to a comparison of sound signals picked up by respective microphones, select the microphone farthest from the main microphone as an auxiliary microphone according to a preset relative position of respective microphones, and execute a noise reduction algorithm by using a first sound signal picked up by the main microphone and a second sound signal picked up by the auxiliary microphone as inputs of the noise reduction algorithm so as to realize noise reduction.

In the description of the present application, it is to be noted that orientation relation or position relation represented by the terms "on" and "under" is only the orientation relation or position relation shown in the drawings, which is illustrative but not limited, that is to say, it does not indicate or imply that the device or element indicated must have the specific orientation, or must be constructed or handled in such specific orientation; Unless expressly stated and defined otherwise, the terms "mount" and "connect" are to be understood in a broad sense, for example, as a fixed connection, as a detachable connection, or as an integrated connection; it may be a mechanical connection or an electrical connection; it may be directly connected or indirectly connected by means of an intermediate medium, and it may be internal communication of the two elements. The specific meaning of the above terms in the present application may be understood by one of ordinary skill in the art, depending on the specific circumstances.

It should also be noted that in the description of the present application, relational terms such as first and second and the like are used merely to distinguish one entity or operation from another entity or operation, without necessarily requiring or implying any such actual relationship or order between such entities or operations. Moreover, the terms "comprise" "include" or any other variation thereof, are intended to cover a non-exclusive inclusion, such that a process, method, article, or apparatus that comprises a list of elements includes not only those elements but also other elements not expressly listed, or also includes elements inherent to such process, method, article, or apparatus. Without more limitations, the element defined by the statement "comprising a/an" does not exclude the condition that there are additional identical elements in a process, method, article, or apparatus that includes the elements.

Obviously, the above-described embodiments of the present application are merely illustrative of the present application and are not intended to limit the embodiments of the present application. Those skilled in the art, on the basis of the above description, will be able to make other variations or variations, which are not intended to be exhaustive of all the embodiments, and obvious variations or variations, which fall within the scope of the present application, may be made.

The invention claimed is:

1. A noise reduction headset having multi-microphone comprising a headband and headset bodies respectively connected to both ends of the headband, wherein the headset further comprises a microprocessor and at least three microphones disposed on an outer surface of the headset body, wherein, the microprocessor is configured to select the microphone closest to a target sound source as a main microphone according to a comparison of sound signals picked up by respective microphones, select the microphone farthest from the main microphone as an auxiliary microphone according to a preset relative position of respective microphones, and execute a noise reduction algorithm by using a first sound signal picked up by the main microphone and a second sound signal picked up by the auxiliary microphone as inputs of the noise reduction algorithm so as to realize noise reduction.

2. The noise reduction headset having multi-microphone according to claim 1, wherein the at least three microphones are respectively arranged on an edge of the outer surface of the headset body.

3. The noise reduction headset having multi-microphone according to claim 2, wherein the noise reduction headset having multi-microphone comprises at least four microphones, wherein the at least four microphones are circumferentially and uniformly distributed on the edge of the outer surface of the headset body.

4. The noise reduction headset having multi-microphone according to claim 3, wherein the microprocessor is configured to fuse and compare the sound signals picked up by the microphones other than the main and auxiliary microphones with the second sound signal picked up by the auxiliary microphone according to the preset relative positions of the microphones, so as to obtain the virtually picked-up fused sound signal from the position of the edge of the outer surface of the headset body remote from the main microphone in the extension line of the line between the main microphone and the target sound source, and use the first sound signal and the fused sound signal as inputs of the noise reduction algorithm.

5. The noise reduction headset having multi-microphone according to claim 2, wherein the microprocessor is configured to fuse and compare the sound signals picked up by the microphones other than the main and auxiliary microphones with the second sound signal picked up by the auxiliary microphone according to the preset relative positions of the microphones, so as to obtain the virtually picked-up fused sound signal from the position of the edge of the outer surface of the headset body remote from the main microphone in the extension line of the line between the main microphone and the target sound source, and use the first sound signal and the fused sound signal as inputs of the noise reduction algorithm.

6. The noise reduction headset having multi-microphone according to claim 5, wherein at least one other microphone is arranged in the vicinity of the auxiliary microphone.

7. A multi-microphone noise reduction method comprising:

arranging at least three microphones on the outer surface of the headset body;

selecting the microphone closest to a target sound source as a main microphone according to a comparison of sound signals picked up by respective microphones, selecting the microphone farthest from the main microphone as an auxiliary microphone according to a preset relative position of respective microphones, and executing a noise reduction algorithm by using a first sound signal picked up by the main microphone and a second sound signal picked up by the auxiliary microphone as inputs of the noise reduction algorithm so as to realize noise reduction.

8. The multi-microphone noise reduction method according to claim 7, wherein the arranging at least three microphones on the outer surface of the headset body further comprises arranging at least three microphones on the edge of the outer surface of the headset body.

9. The multi-microphone noise reduction method according to claim 8, wherein the arranging at least three microphones on the edge of the outer surface of the headset body further comprises circumferentially and uniformly distributing at least four microphones on the edge of the outer surface of the headset body.

10. The multi-microphone noise reduction method according to claim 9, further comprising:

fusing and comparing the sound signals picked up by the microphones other than the main and auxiliary microphones with the second sound signal picked up by the auxiliary microphone according to the preset relative position of the microphones, so as to obtain the virtually picked-up fused sound signal from the position of the edge of the outer surface of the headset body remote from the main microphone in the extension line of the line between the main microphone and the target sound source, and use the first sound signal and the fused sound signal as inputs of the noise reduction algorithm.

11. The multi-microphone noise reduction method according to claim 7, further comprising:

fusing and comparing the sound signals picked up by the microphones other than the main and auxiliary microphones with the second sound signal picked up by the auxiliary microphone according to the preset relative position of the microphones, so as to obtain the virtually picked-up fused sound signal from the position of the edge of the outer surface of the headset body remote from the main microphone in the extension line of the line between the main microphone and the target sound source, and use the first sound signal and the fused sound signal as inputs of the noise reduction algorithm.

12. The multi-microphone noise reduction method according to claim 8, further comprising:

fusing and comparing the sound signals picked up by the microphones other than the main and auxiliary microphones with the second sound signal picked up by the auxiliary microphone according to the preset relative position of the microphones, so as to obtain the virtually picked-up fused sound signal from the position of the edge of the outer surface of the headset body remote from the main microphone in the extension line of the line between the main microphone and the target sound source, and use the first sound signal and the fused sound signal as inputs of the noise reduction algorithm.

* * * * *